US005192059A

United States Patent [19]

Silver

[11] Patent Number: 5,192,059

[45] Date of Patent: Mar. 9, 1993

[54] FASCIA BOARD HOLDER

[76] Inventor: Earl Silver, RR4, Napanee, Ontario, Canada, K7R 3K9

[21] Appl. No.: 873,780

[22] Filed: Apr. 27, 1992

[51] Int. Cl.[5] ..... B25B 5/14

[52] U.S. Cl. ..... 269/41; 269/45; 269/904

[58] Field of Search ..... 269/904, 41, 45, 82, 269/152, 154, 155, 98; 52/702, 127; 248/215; 29/281.1, 281.5, 281.6

[56] References Cited

U.S. PATENT DOCUMENTS 1,126,053 1/1915 McGough ..... 269/45
1,987,826 1/1935 Heumann ..... 269/98
3,776,539 12/1973 Curtis et al. ..... 269/45
4,264,063 4/1981 Halula ..... 269/41
4,340,100 7/1982 Anderson ..... 269/41
4,836,517 6/1989 Vossler ..... 269/41
5,054,755 10/1991 Hawkes ..... 269/41

*Primary Examiner*—Robert C. Watson
*Attorney, Agent, or Firm*—Richard J. Hicks

[57] ABSTRACT

An adjustable fascia board holder which comprises a channel section mountable on a roof rafter and having a pivotally mounted quadrant thereon which can be locked at any selected angle thereto. A second open channel is mounted on the quadrant at right angles thereto to receive a fascia board therein and hold it against the end of the rafter to facilitate nailing of the board to the rafter.

5 Claims, 1 Drawing Sheet

FASCIA BOARD HOLDER

FIELD OF INVENTION

This invention relates to a device for holding fascia boards in position for attachment to rafter ends. More particularly the invention relates to an adjustable holder for holding the fascia board in a vertical plane, regardless of the pitch of the rafters.

BACKGROUND OF INVENTION

When building a roof, the rafters or trusses are secured to the frame of the house so as to provide the design pitch of the roof. Typically a house roof has a pitch of about 3 in 12 but this may vary from 2 in 12 (relatively flat) to about 8 in 12 (very steep). The lower ends of the rafters are cut square to receive the fascia board, which is generally, but not always, designed to lie in a vertical plane. The carpenter must nail one end of the fascia in place on the appropriate rafter, often with no one available to hold up the other end. Temporary hangers may, of course, be used to hold up and align multiple fascia boards and numerous devices, such as those described in U.S. Pat. Nos. 305,776 of Sep. 30, 1884 and 4,264,063 of Apr. 28, 1981, have been suggested. None of the prior art devices, however, takes into consideration the fact that roof pitches vary from building to building and they are not, therefore, adjustable.

There is, therefore, a need for an adjustable holder to temporarily hold a fascia board in the proper location for attachment to a roof rafter, regardless of the pitch of the roof.

OBJECT OF THE INVENTION

Thus, it is an object of the present invention to provide an adjustable fascia board holder.

BRIEF STATEMENT OF INVENTION

By one aspect of this invention there is provided a fascia board holder for removable attachment adjacent one end of a roof rafter, said holder comprising:

(a) a first channel section adapted to receive said roof rafter;

(b) means to releasably secure said channel section to said rafter;

(c) a planar element pivotally mounted on said channel section for rotation about a horizontal axis when said channel section is operatively mounted on said roof rafter;

(d) means to releasably secure said planar-element in a selected angular position relative to said channel section; and (e) a second channel section rigidly mounted on planar element in a plane perpendicular thereto, adapted to slidably receive and retain therein a fascia board in perpendicular abutting relation to said rafter.

DETAILED DESCRIPTION OF PREFERRED EMBODIMENTS

Figure 1:
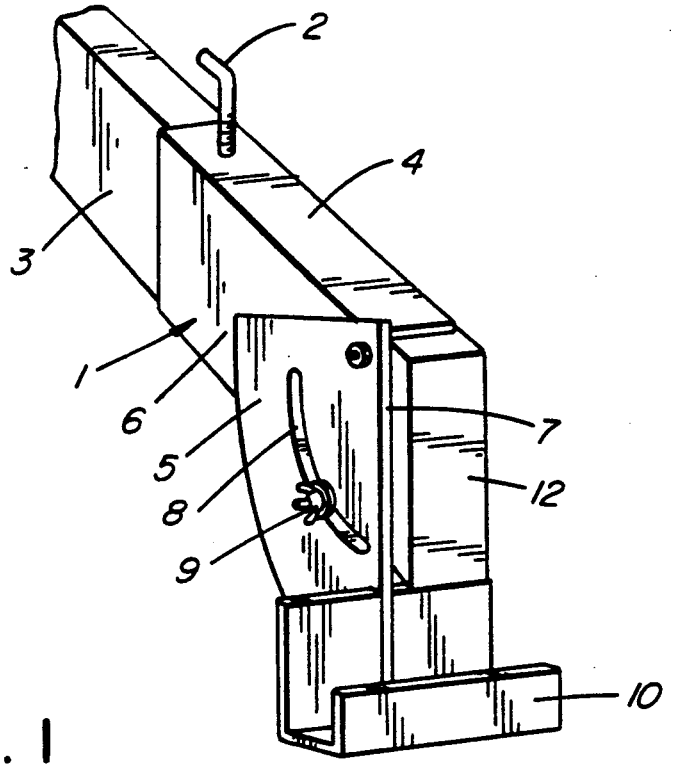
FIG. 1 is a perspective view of an adjustable holder according to the present invention.
Figure 2:
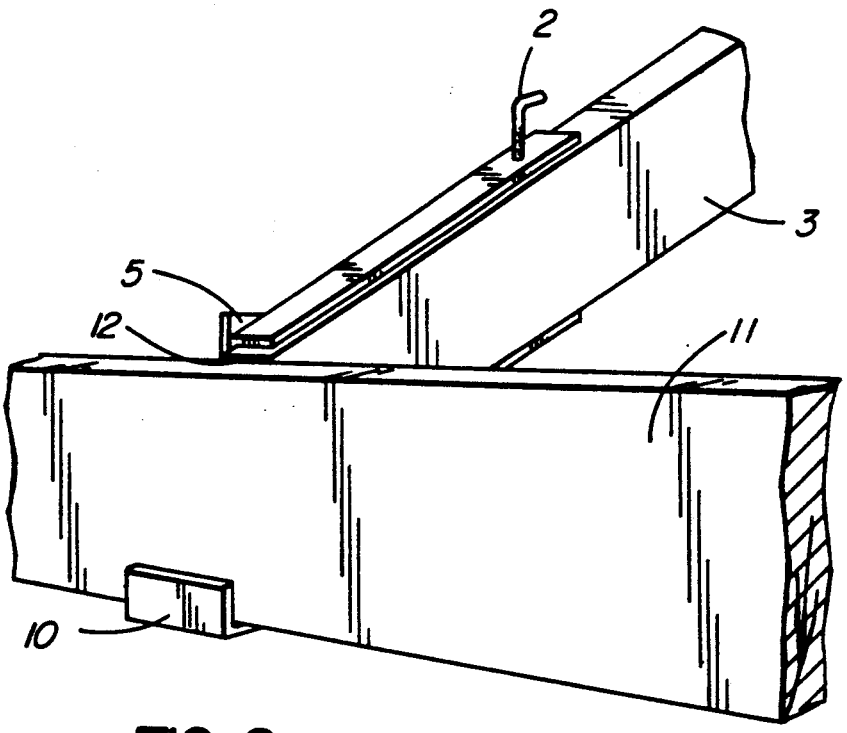
FIG. 2 is a perspective view of the holder of FIG. 1 with the fascia board in operative position.

As seen in FIG. 1, the present invention provides a longitudinally extending open channel section 1, which may be described as substantially C shaped in cross section. Channel 1 is usually about 1 foot long and adapted to receive a standard 2"×4" or 2"×6" rafter in the open channel. Other sizes may, of course be fabricated as required. Generally channel 1 is an aluminum extension. At one longitudinal end, a clamping screw 2 is threadably inserted through the 2" side 4 to provide a clamp to secure the channel on a rafter 3. A planar quadrant 5 generally of aluminum sheet is pivotally mounted in a plane parallel face 6 by a bolt 7 through face 6. Quadrant 5 is provided with an accurate slot 8 and a clamping nut 9 so as to lock the quadrant firmly in any selected angular position relative to the face 4. A U-shaped channel 10 is rigidly mounted on quadrant 5 in a plane perpendicular thereto, with its open side vertically upwards, when mounted in operative position on a rafter, so as to receive a fascia board 11 therein and support it in abutting planar relationship with the end 12 of the rafter 3, as shown in FIG. 2.

For convenience a second holder is mounted on the rafter adjacent the other end of the fascia board so as to support the fascia board in a vertical plane and substantially parallel to the ground. Once the fascia 11 is in place, clamping nuts 9 can be loosened so as to make final angular adjustments and then tightened. The fascia board can then be secured to the ends 12 of each rafter 3 along the length thereof, usually by means of nails or screws. When the fascia board is securely mounted, clamping screws 2 can be loosened and the channel 1 removed from the rafter for use with the next fascia board.

It will be appreciated that while this invention has made reference to fabrication in aluminum sheet, other materials such as plastics or steel may equally well be employed.

I claim:

1. A fascia board holder for removable attachment adjacent one end of a roof rafter, said holder comprising:

(a) a first channel section adapted to receive said roof rafter;

(b) means to releasably secure said channel section to said rafter;

(c) a planar quadrant element pivotally mounted on said channel section for rotation about a horizontal axis when said channel section is operatively mounted on said roof rafter;

(d) means to releasably secure said planar-element in a selected angular position relative to said channel section; and (e) a second channel section rigidly mounted on planar element in a plane perpendicular thereto, adapted to slidably receive and retain therein a fascia board in perpendicular abutting relation to said rafter.

2. A fascia board holder as claimed in claim 1 fabricated from aluminum alloy sheet material.

3. A fascia board holder as claimed in claim 1 fabricated from steel.

4. A fascia board holder as claimed in claim 1 wherein said means to releasably secure said quadrant element comprises arcuate slot means in said quadrant element and a clamping nut cooperating therewith.

5. A fascia board holder as claimed in claim 4 wherein said means to releasably secure said first channel section to said rafter comprises thumb screw means rotatably mounted in a marginal side wall of said first channel section.

* * * * *